US007716879B2

(12) United States Patent
George

(10) Patent No.: US 7,716,879 B2
(45) Date of Patent: May 18, 2010

(54) WINDOW WELL

(75) Inventor: Glen R. George, Grand Ledge, MI (US)

(73) Assignee: Tapco International Corporation, Wixom, MI (US)

( * ) Notice: Subject to any disclaimer, the term of this patent is extended or adjusted under 35 U.S.C. 154(b) by 272 days.

(21) Appl. No.: 11/670,505

(22) Filed: Feb. 2, 2007

(65) Prior Publication Data

US 2007/0130846 A1 Jun. 14, 2007

Related U.S. Application Data

(63) Continuation of application No. 10/725,219, filed on Dec. 1, 2003, now Pat. No. 7,171,786.

(51) Int. Cl.
*E04C 2/32* (2006.01)

(52) U.S. Cl. ..... 52/107; 52/783.11; 52/783.17; 52/182; 52/184; 52/190; 403/345

(58) Field of Classification Search ..... 52/107, 52/195, 522, 529, 783.11, 783.17, 783.19, 52/182, 184, 190; 403/345, 105; 285/424, 285/921

See application file for complete search history.

(56) References Cited

U.S. PATENT DOCUMENTS

| | | | | |
|---|---|---|---|---|
| 1,916,202 A | | 7/1933 | Bubien | |
| 2,162,628 A | | 6/1939 | Martin | |
| 2,308,131 A | | 1/1943 | Wellnitz | |
| 2,936,504 A | | 5/1960 | Harris | |
| 3,004,634 A | * | 10/1961 | Evans et al. | 52/107 |
| 3,667,185 A | * | 6/1972 | Maurer | 52/537 |
| 3,844,076 A | | 10/1974 | Schock | |
| 3,848,378 A | | 11/1974 | Witte | |
| 3,969,866 A | | 7/1976 | Kyne | |
| 3,999,334 A | | 12/1976 | Webb | |
| 4,226,062 A | | 10/1980 | Doane | |
| 4,330,500 A | | 5/1982 | Mackes | |

(Continued)

FOREIGN PATENT DOCUMENTS

CH 561831 A 5/1975

(Continued)

OTHER PUBLICATIONS

Exhibit A is a StormTech SC-740 culvert that was offered for sale at least as early as Nov. 2002, dated Nov. 24, 2003, 17 pages.

(Continued)

*Primary Examiner*—Jeanette Chapman
(74) *Attorney, Agent, or Firm*—Howard & Howard Attorneys PLLC

(57) ABSTRACT

A modular window well arrangement includes one or more window well members. The window well members can be interconnected in a vertically stacked arrangement to provide the required overall height. Snap-connectors interconnect the vertically adjacent window well members, and a plurality of steps provide for escape. The window well members may have different sizes, and extension walls may be utilized to increase the size of the window well members to provide for a wide variety of configurations. The window well members may be made of a relatively lightweight structural foam material.

14 Claims, 5 Drawing Sheets

U.S. PATENT DOCUMENTS

| | | | | | |
|---|---|---|---|---|---|
| 4,704,828 | A | * | 11/1987 | Kemp | 52/107 |
| 4,876,833 | A | | 10/1989 | Gefroh et al. | |
| 4,945,624 | A | * | 8/1990 | Toti | 29/453 |
| 5,107,640 | A | | 4/1992 | Gefroh et al. | |
| 5,657,587 | A | | 8/1997 | Gefroh | |
| 5,692,347 | A | * | 12/1997 | Hulek | 52/537 |
| 5,881,503 | A | | 3/1999 | Eichelberger | |
| D425,207 | S | | 5/2000 | Sharpe et al. | |
| 6,298,631 | B1 | | 10/2001 | Finley | |
| 6,408,577 | B1 | | 6/2002 | Desjoyaux et al. | |
| D466,221 | S | | 11/2002 | Oakley | |
| 6,484,451 | B1 | | 11/2002 | Gavin | |
| 6,484,455 | B1 | | 11/2002 | Poole | |
| D472,978 | S | | 4/2003 | Oakley | |
| 6,715,243 | B1 | | 4/2004 | Fons | |
| 6,773,206 | B2 | | 8/2004 | Bradley et al. | |
| 2003/0167705 | A1 | * | 9/2003 | Oakley | 52/107 |

FOREIGN PATENT DOCUMENTS

| | | | |
|---|---|---|---|
| DE | 2318702 | A1 | 10/1974 |
| DE | 3727713 | A1 | 3/1989 |
| EP | 0516606 | A1 | 12/1992 |
| JP | 2000248569 | A | 9/2000 |

OTHER PUBLICATIONS

Exhibit B is a brochure for MAR-FLEX Window Well offered for sale at least as early as Jan. 2002, 4 pages.
Exhibit C is a brochure for SCAPEWEL Window Well systems offered for sale at least as early as Jan. 1999, 4 pages.
Exhibit D is a brochure for Wellcraft Egress Window wells Model 2040 offered for sale at least as early as Sep. 1998, 4 pages.
Exhibit E is a brochure for Wellcraft Window Wells Model 2060 offered for sale at least as early as May 1997, 5 pages.
Exhibit F is a copy of line drawings for Wellcraft Egress Window Wells Model 2062 offered for sale at least as early as Dec. 1999, 3 pages.
Exhibit G is a brochure for Wellcraft Egress Window Wells Model 2067 offered for sale at least as early as Jan. 2000, 5 pages.
English language abstract for CH 561831, 5 pages.
English language abstract for DE 2318702 16, pages.
English language translation and abstract for DE3727713, 10 pages.
English language abstract for EP 0516606, extracted from espacenet.com database, dated Feb. 10, 2009, 11 pages.
English language translation and abstract for JP 2000248569, extracted from PAJ database, dated Feb. 13, 2009, 46 pages.

* cited by examiner

WINDOW WELL

CROSS REFERENCE TO RELATED APPLICATIONS

This application is a continuation of U.S. patent application Ser. No. 10/725,219, filed Dec. 1, 2003 now U.S. Pat. No. 7,171,786 and incorporated herein by reference in its entirety.

BACKGROUND OF THE INVENTION

Various window wells for attachment to a building having basement windows have been developed. Such window wells can be quite large, and are often made from concrete, steel, or other heavy material. The size and weight of the wells can make them difficult to transport and handle during assembly at the construction site. Also, known window wells may be made of a single size and configuration, such that the number of possible configurations available is limited.

SUMMARY OF THE INVENTION

One aspect of the present invention is a modular window well including first and second unitary wall members. Each of the wall members define upper and lower edges, and generally vertical opposite side edges. Each wall member includes at least one wedge adjacent each opposite side edge and adjacent a selected one of the upper and lower edges. Each wedge defines a generally horizontal axis and a side edge extending at an acute angle relative to the horizontal axis and a retaining edge extending transverse to the horizontal axis. Each wall member further includes at least one wedge-engaging surface adjacent each opposite side edge and adjacent the other of the upper and lower edges. The retaining edges of the wedges engage the wedge-engaging surfaces to interconnect the first and second wall members in a vertically stacked configuration.

Another aspect of the present invention is a modular window well including a generally vertical wall member having spaced apart first and second end portions. Each end portion includes a connecting structure for securing the window well to the foundation of a building or to an extension wall member. The vertical wall member has a central portion horizontally spaced from the first and second end portions to define a central space bounded by the end portions and the central portion. The modular window well also includes first and second extension wall members having first side edge portions secured to the first and second end portions of the vertical wall member. Each extension wall member further includes a second side edge portion having connecting structure for securing the extension wall member to the foundation of a building.

Yet another aspect of the present invention is a modular window well including first and second wall members, each having opposite side edges including attachment flanges for securing the first and second wall members to the foundation of a building. The first and second wall members have a central portion spaced horizontally from the side edges to form a central space. The first and second wall members are vertically stacked, and the attachment flanges of the first wall member include offset portions that overlap a portion of the attachment flanges of the second wall member.

The window well members are preferably made of a structural foamed polymer material, such that the window well members are lightweight, and easily transported and handled by a single worker. Also, because the window well is composed of smaller wall members, the weight of the individual wall members is relatively small, further facilitating transport and installation by a single worker.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
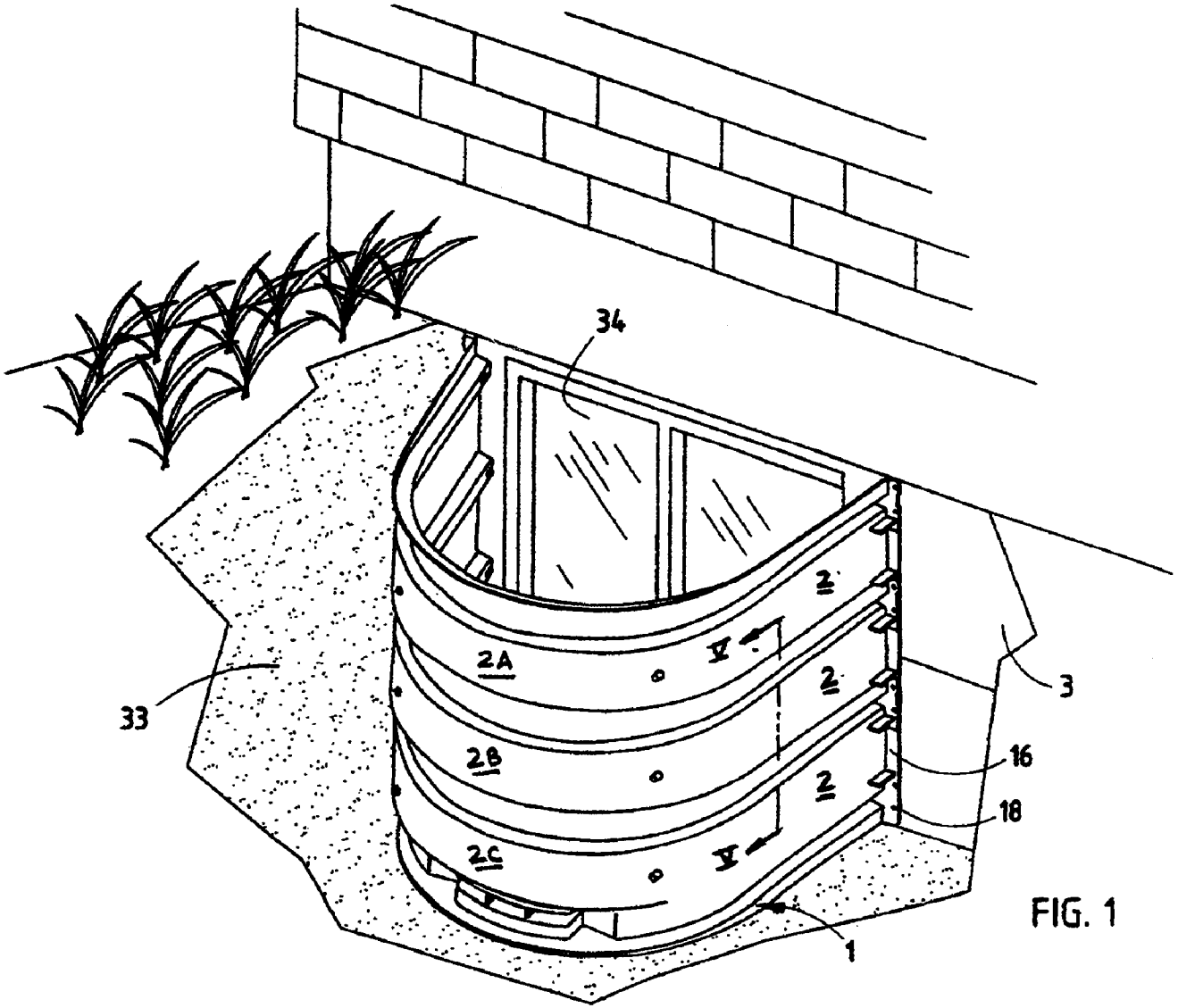
FIG. 1 is a perspective view of a modular window well according to one aspect of the present invention, shown installed against a building foundation.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
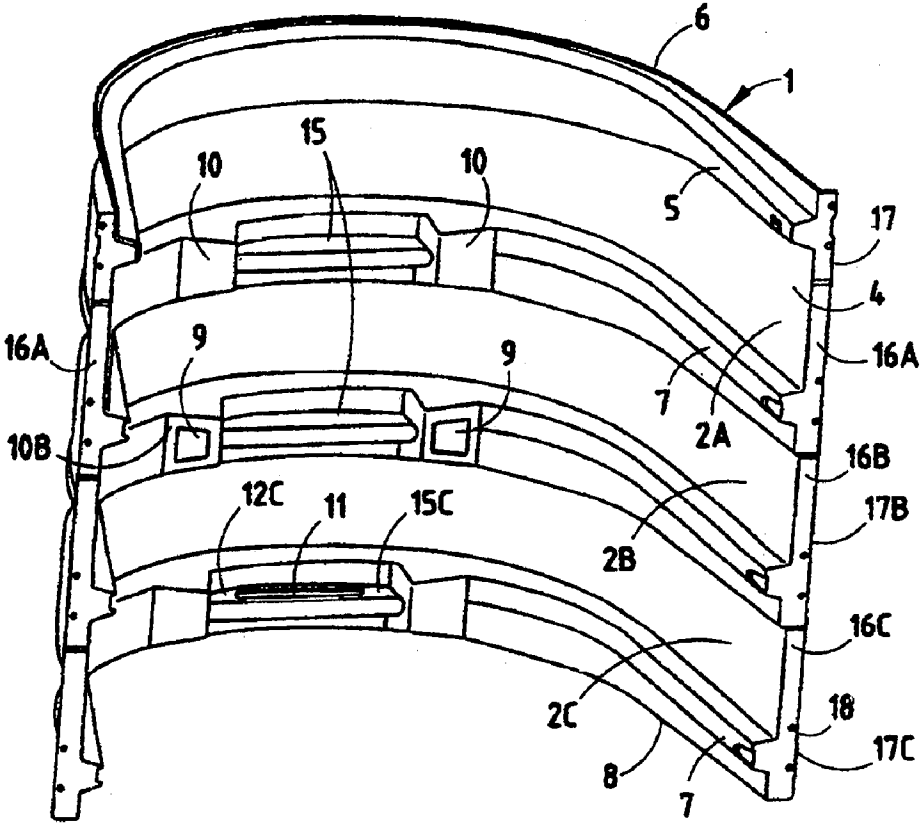
FIG. 2 is a perspective view of a window well according to the present invention.

As illustrated in FIG. 1, a modular window well 1 according to one aspect of the present invention includes a plurality of unitary window well members 2 that are stacked vertically and attach to a foundation 3 of a building. As shown, the unitary window well members 2 in the depicted vertically stacked arrangement are also respectively designated 2A, 2B or 2C, and features particular to or exemplified by a respective, vertically arranged window well member 2A, 2B or 2C likewise include the reference numeral suffix A, B or C in the following description and in the drawings. Each of the window well members 2 includes a sidewall 4 having an upper channel 5 extending around the sidewall 4 adjacent the upper peripheral edge 6 of the window well member 2. Each window well member 2 further includes a lower channel 7 extending adjacent the lower peripheral edge 8 of each window well member 2. As perhaps best shown in FIGS. 2, 4 and 6, upper channel 5 and lower channel 7 each extends continuously between the first and second vertical end portions 17 of each window well member 2. When window well members 2 are vertically stacked, the upper channel 5 is received in, and overlaps, the lower channel 7 of the vertically adjacent window well member 2. Steps 15 (see also FIG. 2) are integrally formed in the lower channels 7 to provide for escape from the building through window 34. The window well members may optionally include openings 9 in vertical side faces 10 of a window well member 2B to provide a handle to assist in use of steps 15 to escape the building. Alternately, an opening 11 may be provided in an upper sidewall 12 of an integral step 15C. When the modular window well 1 is installed to the foundation 3, the adjacent soil 33 is filled in around the modular window well 1. The modular window well 1 thereby retains the soil 33, and permits light to enter the basement windows 34 of the building.

Figure 3:
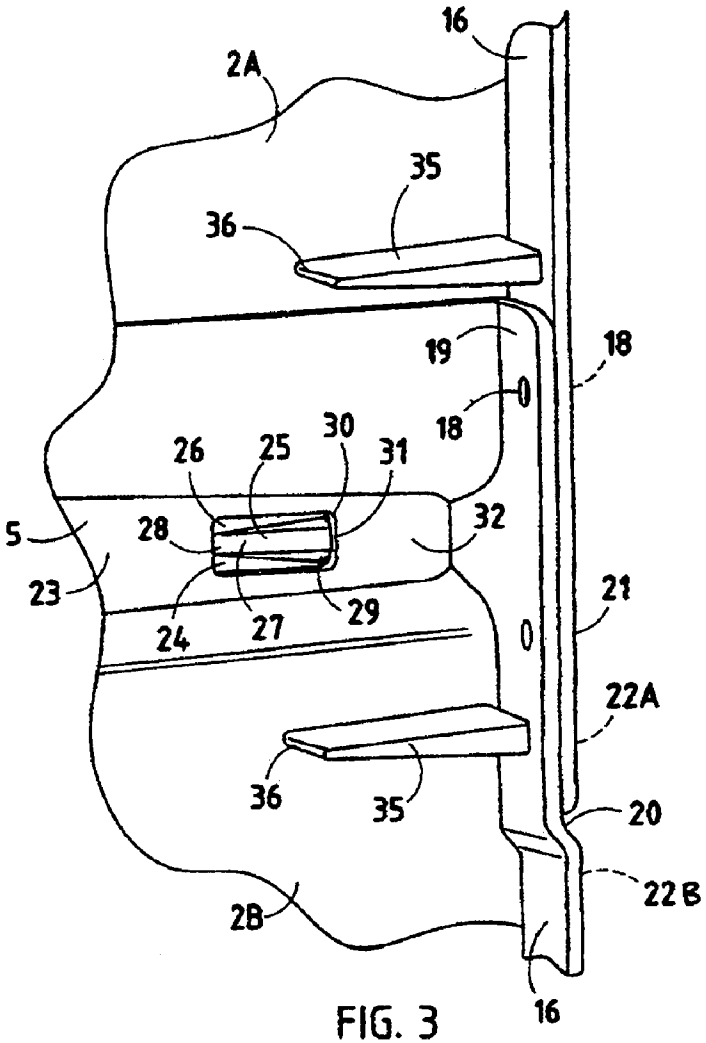
FIG. 3 is an exterior, fragmentary, enlarged view showing a snap-attachment arrangement for interconnecting vertically adjacent window well members.

An attachment flange 16 extends along the vertical end portions 17 of each window well member, and a plurality of openings 18 through the attachment flanges 16 permit use of conventional fasteners or the like to secure the window well members 2 to the foundation 3 of a building. With further reference to FIG. 3, an upper end portion 19 of each attachment flange 16 is offset at 20, and overlaps the lower end 21 of the attachment flange 16 of the above, vertically adjacent window well member, such that the surfaces 22B and 22A of the adjacent attachment flanges are aligned. Thus, the attachment flanges 16 of window well 1 can fit tightly against the foundation 3 despite the overlap.

Vertically adjacent window well members can be quickly and easily interconnected using a snap-attachment arrangement including a barb 25 and opening 24. Each upper channel 5 includes a vertical or base wall 23 having an opening 24 therethrough adjacent the attachment flange 16. A barb or wedge 25 extends outwardly from the vertical sidewall 26 of the lower channel 7 of the upper window well member 2A and through the opening 24 of the lower window well member 2B. The barb or wedge 25 includes an outer edge 27 that extends from a first end 28 that tapers down to the vertical sidewall 26 (see also FIG. 4), and includes a second end 29 extending into the opening 24. A transverse end edge 30 of wedge 25 contacts edge 31 of opening 24 to thereby interconnect the window well member 2A to the window well member 2B. The wedge 25 extends horizontally outwardly from the sidewall 26, such that the tapered outer edge 27 and the transverse edge 30 form a triangle shape. During assembly of modular window well 1 from a plurality of individual units of window well members 2, the upper window well member 2A is positioned adjacent the lower window well member 2B with the upper channel 5 of the window well member 2B partially inserted into the lower channel 7 of the upper window well member 2A. As the upper window well member 2A is horizontally shifted, the outer edge 27 of wedge 25 slides along the end portion 32 of sidewall 23, until it is aligned with the opening 24. The wedge 25 then snaps into the opening 24, and interconnects the vertically adjacent window well members 2A and 2B. The openings 18 through the attachment flanges 16 at the overlapping portions 19 and 21 are aligned with each other, such that a fastener can be inserted through both openings, thereby further securing the vertically adjacent window well members 2 to one another. In this way, the desired height for a particular application can be readily achieved by interconnecting the required number of window well members 2 in a vertically stacked configuration.

The window well members 2 also include provisions to facilitate nesting for transport, storage, and the like. Each window well member 2 includes a pair of tabs or stops 35 having an end 36. During shipping, two or more window wells 2 can be nested within one another, with the upper channels 5 fitting into the upper channels 5 of the adjacent window well members 2, and with the lower channels 7 of each window well 2 nesting into the lower channels 7 of the adjacent window wells 2. When in the nested configuration, the ends 36 of tabs 35 contact the attachment flanges 16 of the adjacent window well member 2 to thereby position the adjacent window well members 2 and prevent the adjacent window well members 2 from becoming tightly nested together in a manner that would otherwise damage the window well members 2 and/or make separation difficult.

Figure 4:
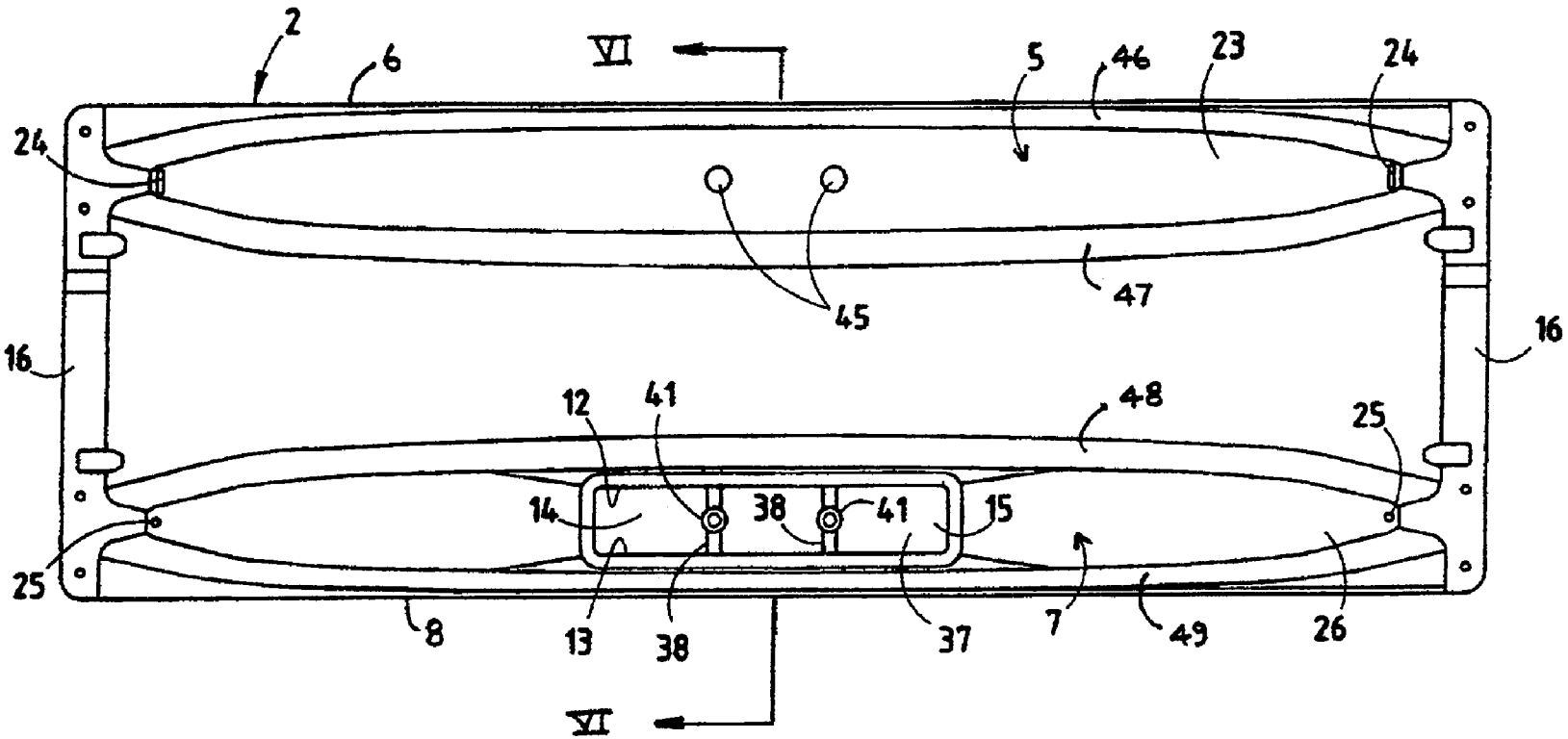
FIG. 4 is an exterior plan view of a window well member.
Figure 6:
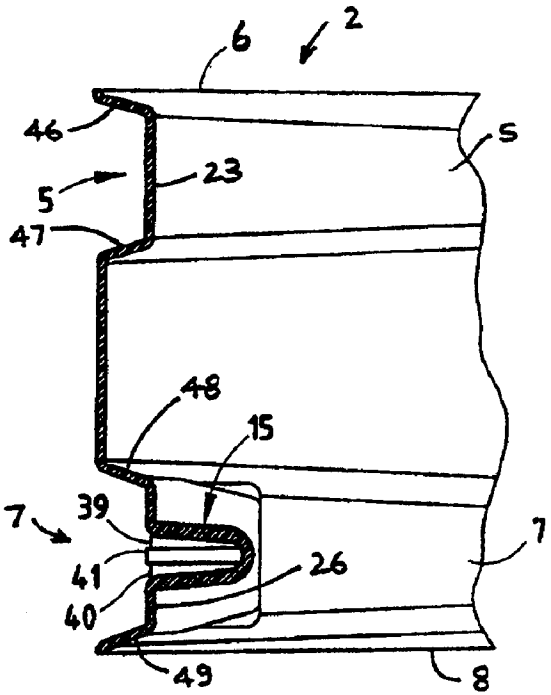
FIG. 6 is a cross-sectional view taken along the line VI-VI of FIG. 4.
Figure 5:
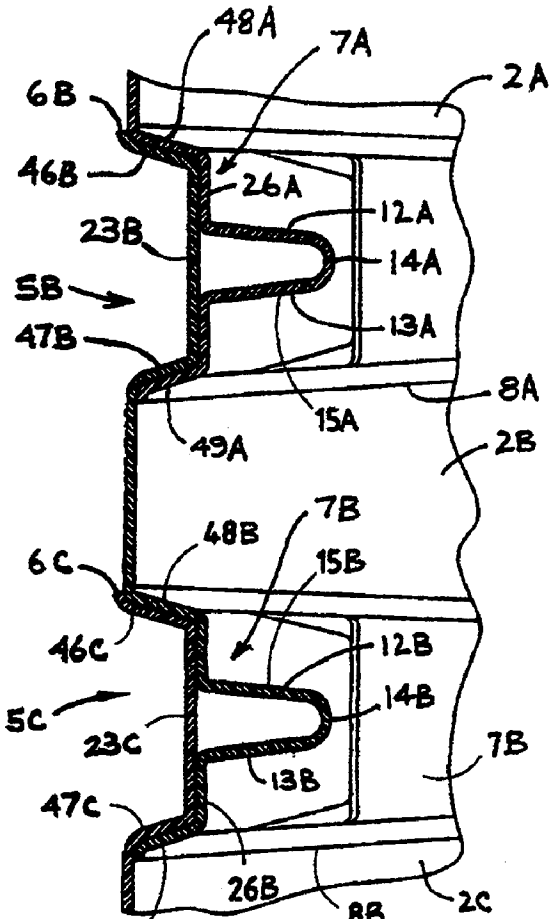
FIG. 5 is a cross-sectional view taken along the line V-V of FIG. 1.

With reference to FIGS. 4-6, each upper channel 5 includes a sidewall 23, and an upper sidewall 46 of channel 5 that tapers outwardly to the peripheral edge 6 of the window well member 2. A lower sidewall 47 of channel 5 extends outwardly and downwardly from the sidewall 23 of upper channel 5. The lower channel 7 of each window well member 2 includes a side or base wall 26, and an upper sidewall 48 of channel 7 that extends outwardly from the vertical sidewall 26. A lower sidewall 49 of channel 7 extends outwardly from vertical sidewall 26 to the lower peripheral edge 8 of window well member 2. When the vertically adjacent window well members 2 are assembled, sidewall 23 fits closely against vertical sidewall 26, and upper sidewall 46 of channel 5 fits closely against upper sidewall 48 of channel 7. Also, the lower sidewall 47 of channel 5 fits closely against lower sidewall 49 of channel 7. The wedging action between the walls 46 and 48, and the walls 47 and 49, locate the vertically adjacent window well members relative to one another, and the contact between the sidewalls 46 and 48 and the sidewalls 47 and 49 react against vertical loads. This arrangement provides a very secure interconnection between the vertically adjacent window well members 2, and also positions the vertically adjacent window well members 2.

Figure 7:
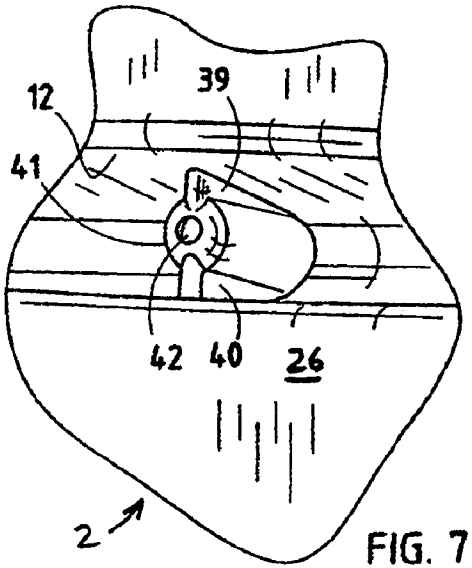
FIG. 7 is a fragmentary, perspective view illustrating the boss and reinforcement rib of the step of the window well member.

With reference to FIG. 4, each step 15 is integrally formed, and includes an upper wall 12, a lower wall 13, and a radiused sidewall 14. A cavity 37 is formed between the walls 12 and 13, and a pair of reinforcement ribs 38 extend between and interconnect the sidewalls 12 and 13 to provide increased strength in the step 15. With further reference to FIGS. 6 and 7, each reinforcement rib 38 includes an upper rib portion 39, a lower rib portion 40, and an integral boss 41 having a generally cylindrical outer surface. The boss 41 includes a shallow cavity 42 at the end thereof. A pair of shallow indentations 45 (FIG. 4) are formed in the sidewall 23 of upper channel 5. The indentations 45 provide a guide, such that a worker can drill openings through the sidewall 23 of channel 5 at indentations 45 during installation. When a pair of vertically adjacent window well members 2 are assembled, the indentations or holes 45 of the lower of the two window well members 2 are aligned with the shallow cavities 42 of boss 41 of the upper of the two window well members 2. A threaded fastener can then be inserted through the openings 45 into the cavities 42. Threaded screws having a relatively large thread may be used, such that as the tip of the screw contacts the base of the cavity 42, the screw continues to penetrate the plastic material of the boss 41, thereby tightly drawing together and interconnecting the vertically adjacent, unitary window well members 2.

Figure 8:
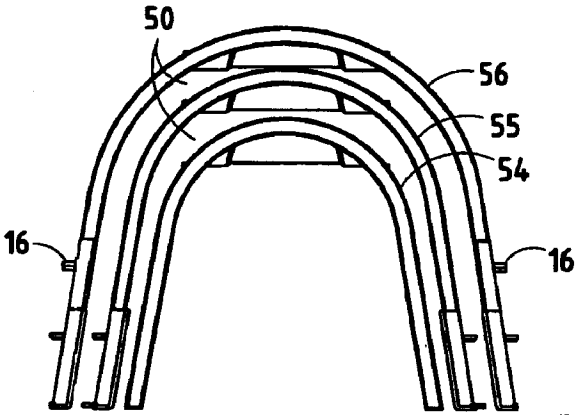
FIG. 8 is a plan view of three window well members of different sizes, wherein the upper window well members are larger, and have extension wall members attached thereto.
Figure 9:
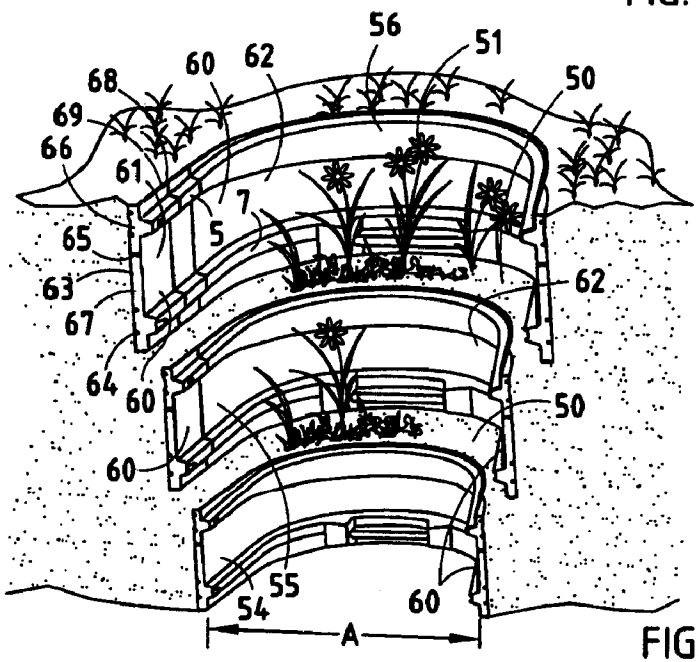
FIG. 9 is a perspective view of the window well arrangement of FIG. 8.

With further reference to FIGS. 8 and 9, the vertically adjacent window well members may be of a different size providing a series of open areas 50 within which plants 51 or the like may be planted. In FIGS. 8 and 9, the lower, smallest window well member is designated 54, the middle, intermediate size window well member is designated 55, and the upper window well member is designated 56. It will be understood that each of the window well members 54, 55, and 56 have substantially the same construction as window well member 2 described in detail above, except that the side-to-side dimension "A" and other dimensions are proportionately different for each of these window well members. One or more extension walls 60 may be utilized to position the upper window well members outwardly, away from the window to provide additional space 50 between vertically adjacent window well members. Each extension wall 60 includes a sidewall 61 having a cross-sectional shape including channels 5 and 7 that is substantially the same as the end portion 62 of the adjacent window well member. Each extension wall 60 includes an attachment flange 63 having a plurality of openings 64 therethrough that align with the openings 18 of the attachment flanges 16 of the window well members. A first end surface 65 of attachment flange 63 includes first an offset portion 66 that is substantially the same as the offset 20 described above in connection with the window well members 2, and has an end portion 67 that is also substantially the same as the remaining portion of the attachment flanges 16 described in detail above. A second attachment flange 69 includes an offset 68 that fits into the offset 20 of an adjacent window well member, or into the offset portion 66 of an adjacent extension wall member 60. The desired number of extension walls 60 can thereby be utilized to position the sidewall members 54, 55, 56 outwardly the required distance for a particular installation.

Figure 10:
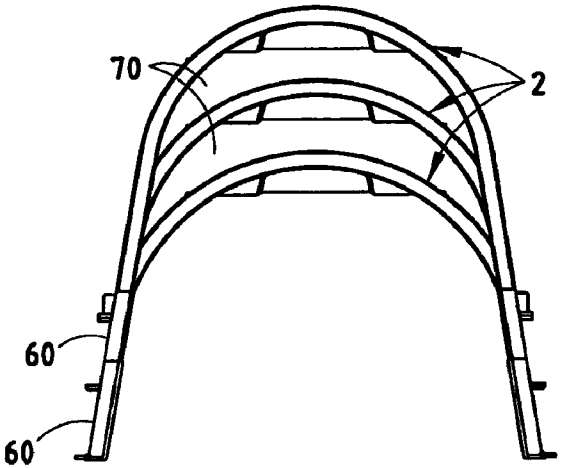
FIG. 10 is a plan view of a window well wherein each of the window well members has the same size, and wherein extension wall members space the upper window well members outwardly.
Figure 11:
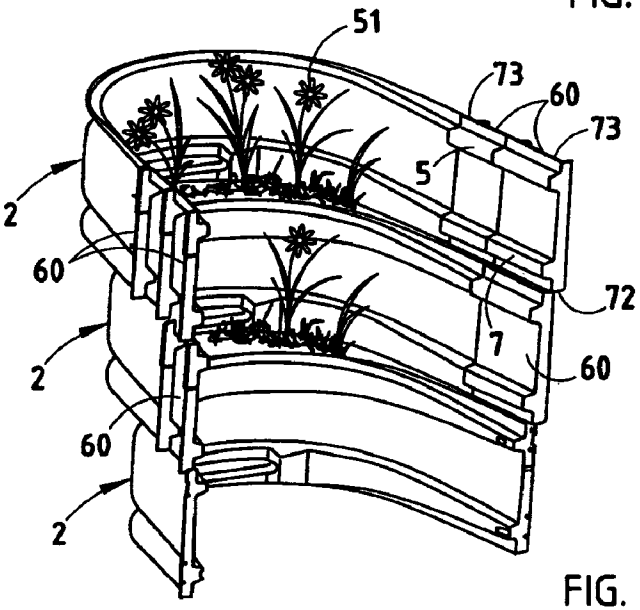
FIG. 11 is a perspective view of the window well arrangement of FIG. 10.

With further reference to FIGS. 10 and 11, one or more extension walls 60 may be connected to vertically adjacent window well members 2, wherein the vertically adjacent window well members 2 are all of the same size. In this way, a series of open areas 70 can be provided for plants 51 and the like. When window wells 2 of the same size are vertically arranged with extension walls 60 as illustrated in FIGS. 10 and 11, the channels 5 and 7 of vertically adjacent window well members 2 and extension wall members 60 do not nest and/or overlap. Rather, the upper edge 73 of a lower extension wall member 60 fits closely against the lower edge 72 of the next vertically adjacent extension wall member 60.

The window well members of the present invention are made of a relatively lightweight structural foam material. The material may be a high density polyethylene with nitrogen therein to form the foam. Other suitable materials may also be utilized. The construction of the window well members provides a strong, lightweight structure that can be readily transported, handled, and installed by a single worker. In contrast, large one piece window wells may be quite difficult to transport and install, requiring use of lifting equipment, multiple workers, and the like. The present invention permits various sized window well members to be utilized to create a wide variety of configurations as required for a particular installation. Furthermore, extension wall members may be connected to the window well members to increase the number of configurations possible. It will be appreciated that the tooling costs and the like for producing a given window well can be substantial, such that the ability to provide a wide variety of configurations utilizing relatively few modular components provides substantial advantages over prior arrangements utilizing large, heavy one-piece window well members.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A modular window well located below grade and secured to a foundation of a building for creating an inward space directly external of a basement egress or window, the modular window well comprising:

an elongated first wall member extending longitudinally across the basement egress or window and extending laterally vertical, the first wall member having substantially horizontal upper and lower peripheral edges, substantially vertical first and second end portions extending between opposite ends of the upper and lower peripheral edges, a first upper sidewall disposed below the upper peripheral edge, a first base wall disposed below the first upper sidewall, a first lower sidewall disposed below the first base wall, a second upper sidewall spaced below the first lower sidewall, a second base wall disposed below the second upper sidewall, a second lower sidewall disposed below the second base wall and above the lower peripheral edge, an upper channel extending horizontally between the first and second end portions and defined by the first upper and lower sidewalls and the first base wall, and a lower channel extending horizontally between the first and second end portions and defined by the second upper and lower sidewalls and the second base wall;

wherein the first base wall is disposed between the first upper and lower sidewalls and laterally extends vertically, and the first upper sidewall and the first lower sidewall oppose one-another and substantially project horizontally outward from the first base wall;

wherein the second base wall is disposed between the second upper and lower sidewalls and laterally extends vertically, and the second upper sidewall and the second lower sidewall oppose one-another and substantially project horizontally outward from the second base wall;

an elongated second wall member being identical to the first wall member and in-part overlapping and projecting laterally upward from the first wall member; and wherein the first upper sidewall of the first wall member is directly adjacent the second upper sidewall of the second wall member and the first lower sidewall of the first wall member is directly adjacent the second lower sidewall of the second wall member for preventing horizontal movement between the first and second wall members.

2. The modular window well set forth in claim 1 wherein the first upper sidewall of the first wall member is disposed below the second upper sidewall of the second wall member.

3. The modular window well set forth in claim 1 wherein the first and second upper sidewalls and the first and second lower sidewalls laterally project substantially horizontally.

4. The modular window well set forth in claim 1 wherein the first and second upper sidewalls and the first and second lower sidewalls laterally project outward from the respective first and second base walls and generally with respect to the foundation.

5. The modular window well set forth in claim 4 wherein the first base wall extends laterally less than the second base wall extends.

6. The modular window well set forth in claim 1 wherein the first base wall extends laterally less than the second base wall extends.

7. The modular window well set forth in claim 1 wherein the first and second wall members are arcuate having an angular displacement of equal to or less than one hundred and eighty degrees between the first and second end portions.

8. The modular window well set forth in claim 1 wherein the lower channel of the second wall member receives the first base wall of the first wall member along an imaginary horizontal plane.

9. A modular window well comprising:

a generally upright, unitary first wall member having opposite first and second end portions each having a vertically extending flange constructed and arranged for attachment to a building foundation on either side of a basement egress;

a central space defined between the first wall member and the basement egress; and the first wall member having a horizontal channel extending continuously between the first and second end portions, the horizontal channel defined by an elongated first base wall laterally extending vertically and between opposing first upper and lower sidewalls for structural integrity, and an elongated step projecting laterally from the first base wall and into the central space and attached to at least one of the first base wall, the first upper sidewall and the first lower sidewall for structural rigidity, the step unconnected to another said step defined in the unitary first wall member except through at least one of the first base wall, the first upper sidewall and the first lower sidewall.

10. The modular window well set forth in claim 9 further comprising:

a generally upright second wall member overlapping at least in part the first wall member, the second wall member having a horizontal channel defined by an elongated second base wall laterally extending vertically and between opposing second upper and lower sidewalls for structural integrity; and wherein the second base wall is directly adjacent to the first base wall.

11. The modular window well set forth in claim 9 further comprising:

a generally upright second wall member overlapping at least in part the first wall member, the second wall member having a horizontal channel defined by an elongated second base wall laterally extending vertically and between opposing second upper and lower sidewalls for structural integrity; and wherein the second upper sidewall is directly adjacent to the first upper sidewall.

12. The modular window well set forth in claim 9 further comprising:

a generally upright second wall member overlapping at least in part the first wall member, the second wall member having a horizontal channel defined by an elongated second base wall laterally extending vertically and between opposing second upper and lower sidewalls for structural integrity; and wherein the second lower sidewall is directly adjacent to the first lower sidewall.

13. The modular window well set forth in claim 9 wherein the step has a horizontal upper wall and at least one vertically extending rib engaged between the horizontal upper wall and at least one of the first base wall, the first upper sidewall and the first lower sidewall.

14. The modular window well set forth in claim 9 wherein the step has a horizontal upper wall having an opening for gripping the step.

* * * * *